US008951367B2

(12) United States Patent
Kawamura et al.

(10) Patent No.: US 8,951,367 B2
(45) Date of Patent: Feb. 10, 2015

(54) ULTRA HIGH STRENGTH COLD ROLLED STEEL SHEET HAVING EXCELLENT BENDABILITY

(75) Inventors: Kenji Kawamura, Chiba (JP); Kazuhiro Seto, Chiba (JP)

(73) Assignee: JFE Steel Corporation (JP)

( * ) Notice: Subject to any disclaimer, the term of this patent is extended or adjusted under 35 U.S.C. 154(b) by 373 days.

(21) Appl. No.: 13/580,421

(22) PCT Filed: Feb. 16, 2011

(86) PCT No.: PCT/JP2011/053882

§ 371 (c)(1),
(2), (4) Date: Oct. 22, 2012

(87) PCT Pub. No.: WO2011/105385

PCT Pub. Date: Sep. 1, 2011

(65) Prior Publication Data

US 2013/0048151 A1 Feb. 28, 2013

(30) Foreign Application Priority Data

Feb. 26, 2010 (JP) ..... 2010-041715

(51) Int. Cl.

| | |
|---|---|
| ***C22C 38/38*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/00*** | (2006.01) |

(52) U.S. Cl.

CPC ..... *C21D 8/0236* (2013.01); *C22C 38/02* (2013.01); *C22C 38/04* (2013.01); *C22C 38/06* (2013.01); *C21D 8/0226* (2013.01); *C21D 8/0257* (2013.01); *C22C 38/001* (2013.01); *C21D 2211/008* (2013.01)

USPC ..... 148/330; 148/320; 148/332; 148/333; 148/334; 148/335; 148/336

(58) Field of Classification Search

None

See application file for complete search history.

(56) References Cited

U.S. PATENT DOCUMENTS

| | | | | |
|---|---|---|---|---|
| 4,108,695 | A * | 8/1978 | Paulitsch et al. | 148/320 |
| 4,180,418 | A * | 12/1979 | Paulitsch et al. | 148/598 |
| 2003/0075250 | A1* | 4/2003 | Ochi et al. | 148/654 |
| 2004/0074575 | A1* | 4/2004 | Kashima et al. | 148/653 |
| 2010/0247957 | A1* | 9/2010 | Hoshika et al. | 428/659 |

FOREIGN PATENT DOCUMENTS

| | | | |
|---|---|---|---|
| JP | 2-175839 | A | 7/1990 |
| JP | 5-195149 | A | 8/1993 |
| JP | 10-130782 | A | 5/1998 |
| JP | 2001-279378 | A | 10/2001 |
| JP | 2002-161336 | A | 6/2002 |
| JP | 2005-256044 | A | 9/2005 |
| JP | 2006-070328 | A | 3/2006 |
| JP | 2006-274335 | A | 10/2006 |
| JP | 2009-030091 | A | 2/2009 |

* cited by examiner

*Primary Examiner* — Deborah Yee

(74) *Attorney, Agent, or Firm* — DLA Piper LLP (US)

(57) ABSTRACT

A cold rolled steel sheet with excellent bendability contains C at 0.15 to 0.30%, Si at 0.01 to 1.8%, Mn at 1.5 to 3.0%, P at not more than 0.05%, S at not more than 0.005%, Al at 0.005 to 0.05% and N at not more than 0.005%, the balance being Fe and inevitable impurities, and has a steel sheet superficial soft portion satisfying:

$$Hv(S)/Hv(C) \leq 0.8 \quad (1)$$

wherein Hv(S) is hardness of the steel sheet superficial soft portion, and Hv(C) is hardness of a steel sheet core portion, $$0.10 \leq t(S)/t \leq 0.30 \quad (2)$$

wherein t(S) is thickness of the steel sheet superficial soft portion, and t is the sheet thickness.

7 Claims, No Drawings

ULTRA HIGH STRENGTH COLD ROLLED STEEL SHEET HAVING EXCELLENT BENDABILITY

RELATED APPLICATIONS

This is a §371 of International Application No. PCT/JP2011/053882, with an international filing date of Feb. 16, 2011 (WO 2011/105385 A1, published Sep. 1, 2011), which is based on Japanese Patent Application No. 2010-041715, filed Feb. 26, 2010, the subject matter of which is incorporated by reference.

TECHNICAL FIELD

This disclosure relates to steel sheets that are suitable for members required to have excellent bendability and delayed fracture resistance, for example, structural members for automobile parts.

BACKGROUND

There has recently been a strong demand for automobile steel sheets to be increased in strength from the viewpoint of enhanced fuel efficiency which leads to environment conservation. To cope with tighter restrictions of carbon dioxide emissions, automobile manufacturers have considered the use of steel sheets exhibiting a tensile strength in excess of 1270 MPa. Further reduction in the thickness of steel sheets has been demanded from the viewpoint of making more lightweight parts, and there has been an increasing need for thin steel sheets having a sheet thickness of 0.8 to 1.6 mm. In general, it is impossible to form ultra high strength cold rolled steel sheets with a tensile strength of 1270 MPa or more by methods such as drawing and stretching which are applicable to forming of mild steel sheets. Thus, bending and stretch flanging are main forming methods used for such ultra high strength cold rolled steel sheets. In the case where ultra high strength cold rolled steel sheets are used for the manufacturing of automobile structural parts, good bendability and stretch flangeability constitute important selection criteria. Further, ultra high strength cold rolled steel sheets with a tensile strength of 1270 MPa or more have a potential to suffer a delayed fracture. Thus, good delayed fracture resistance is another requirement.

As ultra high strength cold rolled steel sheets exhibiting good workability, dual phase steel sheets are known in which hard martensite has been dispersed in a soft ferrite phase to achieve both high strength and workability. The use of such steel sheets has been widespread. Indeed, although such dual phase steel sheets exhibit good ductility, they are poor in bendability and cannot be used for parts manufactured through severe bending. Further, the presence of soft ferrite makes it difficult to ensure a tensile strength exceeding 1270 MPa.

When a steel sheet is worked by bending, an outer peripheral superficial portion undergoes high tensile stress in a circumferential direction while an inner peripheral superficial portion is highly compressively stressed. Thus, the state of superficial portions greatly affects the bendability of an ultra high strength cold rolled steel sheet. That is, it has been known that the provision of a soft superficial layer reduces the tensile and compressive stress applied to the surface when the steel sheet is worked by bending, thereby improving bendability. With regard to high strength steel sheets having a soft superficial layer, Japanese Unexamined Patent Application Publication Nos. 2-175839, 5-195149, 10-130782 and 2002-161336 disclose steel sheets and methods for the manufacturing thereof as described below.

JP '839, which is directed to improving bendability and spot weldability, discloses a high strength steel sheet whose surface layer has been decarburized and annealed and which includes a superficial soft layer representing 10 vol % and an inner, i.e., core, hard layer containing not less than 10 vol % of retained austenite, and a method for manufacturing such steel sheets. The core layer contains as much as 10 vol % or more of retained austenite. However, martensite is formed during forming and voids are generated in the boundaries between the hard phase and soft ferrite, with the result that cracks occur and propagate easily. Thus, such a high content of retained austenite can adversely affect bendability.

JP '149 discloses a cold rolled steel sheet which has superficial soft layers on both sides that represent 3 to 15% and contain C at not more than 0.1 wt %, and in which the remaining portion is a multi phase containing retained austenite at less than 10% as well as a low temperature transformation-forming phase or ferrite. JP '149 further discloses a method for manufacturing such steel sheets. However, the surface hardness of such a steel sheet is markedly decreased because of the superficial soft layers containing C at not more than 0.1 wt %, thus leading to a decrease in terms of fatigue properties. Further, JP '149 is silent with respect to delayed fractures.

JP '782 discloses a cold rolled steel sheet in which a superficial portion extending from each surface to a depth of 10 μm to 200 μm is based on ferrite, and the remaining inner portion is based on bainite and martensite, as well as a method for manufacturing such steel sheets. However, the ferrite-based superficial portions extending from the surface to a depth of 10 μm to 200 μm have a problem of poor fatigue properties.

JP '336 discloses a cold rolled steel sheet with excellent stretch flangeability in which the metal microstructure except portions extending from the surface to a depth of within 10 μm is substantially formed of a martensite single phase, as well as a method for manufacturing such steel sheets. Although JP '336 describes that ferrite may be sometimes formed in the superficial layers having a thickness of 10 μm or less, the disclosed technique is not such that superficial soft layers are formed positively while controlling the proportions of these layers so as to improve workability. Further, the disclosed steel sheet exhibits insufficient bendability.

As described above, there have been no ultra high strength cold rolled steel sheets which exhibit good bendability as well as high strength of 1270 MPa or more and also have excellent delayed fracture resistance.

It could therefore be helpful to provide an ultra high strength cold rolled steel sheet with a sheet thickness of 0.8 to 1.6 mm which exhibits excellent bendability and delayed fracture resistance.

We found that an ultra high strength cold rolled steel sheet with a small thickness which exhibits excellent bendability and tensile strength of not less than 1270 MPa as well as is excellent in terms of delayed fracture resistance after being formed can be obtained by controlling the composition of steel components within an appropriate range and controlling the microstructure.

We thus provide:

(1) An ultra high strength cold rolled steel sheet with excellent bendability which contains, in terms of mass %, C at 0.15 to 0.30%, Si at 0.01 to 1.8%, Mn at 1.5 to 3.0%, P at not more than 0.05%, S at not more than 0.005%, Al at 0.005 to 0.05% and N at not more than 0.005%, with the balance being represented by Fe and inevitable impurities, and has a steel sheet superficial soft portion satisfying Equations (1) and (2):

$$Hv(S)/Hv(C) \leq 0.8 \quad (1)$$

wherein Hv(S) is the hardness of the steel sheet superficial soft portion, and Hv(C) is the hardness of a steel sheet core portion, $$0.10 \leq t(S)/t \leq 0.30 \quad (2)$$

wherein t(S) is the thickness of the steel sheet superficial soft portion, and t is the sheet thickness, the steel sheet superficial soft portion containing tempered-martensite at a volume fraction of not less than 90%, the microstructure of the steel sheet core portion including tempered-martensite, the ultra high strength cold rolled steel sheet having a tensile strength of not less than 1270 MPa.

(2) The ultra high strength cold rolled steel sheet with excellent bendability described in (1), which further contains, in terms of mass %, one or more selected from Ti: 0.001 to 0.10%, Nb: 0.001 to 0.10% and V: 0.01 to 0.50%.

(3) The ultra high strength cold rolled steel sheet with excellent bendability described in (1) or (2), which further contains, in terms of mass %, B at 0.0001 to 0.005%.

(4) The ultra high strength cold rolled steel sheet with excellent bendability described in any one of (1) to (3), which further contains, in terms of mass %, one or more selected from Cu: 0.01 to 0.50%, Ni: 0.01 to 0.50%, Mo: 0.01 to 0.50% and Cr: 0.01 to 0.50%.

Ultra high strength cold rolled steel sheets with a small thickness can be obtained which exhibit an ultra high tensile strength of not less than 1270 MPa and are excellent in terms of bendability and delayed fracture resistance. The ultra high strength cold rolled steel sheets can be used for the production of parts that are difficult to form, for example, automobile structural members, to which application of high strength steel sheets has been difficult. When our ultra high strength cold rolled steel sheet is used for automobile structural members, those steel sheets can contribute to the weight reduction as well as the safety enhancement for automobiles, thus achieving industrial advantages.

DETAILED DESCRIPTION

Examples of our steel sheets will be described in detail below.

First, the chemical composition and the metal microstructure will be separately described. In the following description, the percentage % indicating the chemical composition means mass % unless otherwise specified.

Chemical Composition

C: 0.15 to 0.30%

Carbon is essential for strengthening steel by the formation of a low temperature transformation-forming phase. In general, the strength of a low temperature transformation-forming phase tends to be proportional to the C content. The C content needs to be not less than 0.15% to ensure that a superficial soft portion is formed on the surface of a steel sheet as well as that a tensile strength of not less than 1270 MPa is obtained. However, a C content exceeding 0.30% results in a marked decrease in toughness at a welded portion. Further, such a high carbon content leads to an excessively high strength of steel sheets and tends to result in a marked decrease in the workability, for example, ductility of steel sheets. Thus, the C content is limited to be not less than 0.15% and not more than 0.30%, and preferably not less than 0.15% and not more than 0.25%.

Si: 0.01 to 1.8%

Silicon is an element that improves ductility and contributes to increasing strength. Such effects are not obtained if the silicon content is less than 0.01%, and are saturated even if the silicon content is in excess of 1.8%. Adding silicon in an excessively large amount increases the electrical resistance during resistance welding to deteriorate weldability, and also tends to result in deterioration in terms of chemical conversion properties and post-painting corrosion resistance. Thus, the Si content is limited to be not less than 0.01% and not more than 1.8%, and preferably not less than 0.01% and not more than 1.0%.

Mn: 1.5 to 3.0%

Manganese contributes to the size reduction of crystal grains by exhibiting an effect of lowering the $Ar_3$ transformation point, and functions to increase strength without causing marked decreases in ductility and hole expansion ratio λ. Further, manganese is an important element which suppresses the occurrence of surface cracks attributed to hot shortness caused by sulfur. Furthermore, manganese, which is an austenite stabilizing element, needs to be added at a content of not less than 1.5% from the viewpoint of strength to ensure that austenite which is present during annealing is stably transformed into a low temperature transformation-forming phase during a cooling process. On the other hand, adding manganese in excess of 3.0% leads to an inhomogeneity in the microstructure due to, for example, segregation of manganese, with the result that the steel sheet tends to be deteriorated in workability as well as delayed fracture resistance after being formed. Thus, the Mn content is limited to be not less than 1.5% and not more than 3.0%.

P: not more than 0.05%

Phosphorus is an element that contributes to strengthening steel sheets by forming a solid solution in steel. On the other hand, this element becomes segregated along grain boundaries to lower the grain boundary binding force as well as workability. Further, this element becomes concentrated near the surface of a steel sheet to lower properties such as chemical conversion properties and corrosion resistance. These adverse effects are markedly noticeable if the P content exceeds 0.05%. Thus, it is necessary that the P content be not more than 0.05%. Excessively lowering the P content causes an increase in production costs. In view of this, the P content may be 0.001% or more.

S: not more than 0.005%

Sulfur is an element that adversely affects workability. If the S content is high, this element comes to be present as a MnS inclusion which lowers, in particular, local ductility as well as workability of materials. Further, toughness at welded portions is deteriorated because of the presence of sulfides. These adverse effects can be prevented and press workability can be markedly improved by controlling the S content to be not more than 0.005%. Thus, the S content is limited to be not more than 0.005%. Excessively lowering the S content causes an increase in production costs. In view of this, the S content may be 0.0001% or more.

Al: 0.005 to 0.05%

Aluminum is an effective element for performing deoxidation as well as for increasing the yields of carbide-forming elements. The Al content needs to be not less than 0.005% for these effects to be exhibited sufficiently. Further, this element is essential for increasing the cleanliness of steel sheets. An Al content of not less than 0.005% is necessary from this aspect as well. If the Al content is less than 0.005%, the removal of Si inclusions becomes insufficient to allow a large number of delayed fracture starting points to be present, thereby resulting in easy occurrence of delayed fractures. On the other hand, adding aluminum in excess of 0.05% results in not only a saturation of the effects, but also problems such as deteriorated workability and an increase in the frequency of the occurrence of surface defects. Thus, the Al content is limited to be not less than 0.005% and not more than 0.05%.

N: not more than 0.005%

If the N content is high, large amounts of nitrides are formed and serve as starting points of delayed fractures, thereby increasing the frequency of the occurrence of delayed fractures. To prevent such a problem, it is necessary that the N content be controlled to be not more than 0.005%. Excessively lowering the N content causes an increase in production costs. In view of this, the N content may be 0.0001% or more.

In addition to the aforementioned components, the following elements may be added to the steel.

Titanium, niobium and vanadium reduce the size of crystal grains and contribute to the homogenization of the microstructure. Thus, the addition of these elements is effective for suppressing the occurrence of delayed fractures. This effect may be obtained by adding Ti or Nb at not less than 0.001%, or by adding V at not less than 0.01%. Adding these elements in large amounts is not preferable because carbonitrides are formed. Thus, one or more of these elements may be added at a content of not less than 0.001% and not more than 0.10% for Ti and Nb, and at a content of not less than 0.01% and not more than 0.50% for V.

Boron is preferentially segregated along crystal grain boundaries to strengthen the grain boundaries, thereby suppressing the occurrence of delayed fractures. The B content needs to be not less than 0.0001% to obtain this effect. The effect tends to be saturated even if boron is added in excess of 0.005%. Thus, the B content is preferably in the range of 0.0001 to 0.005%.

Copper, nickel, molybdenum and chromium are elements that contribute to increasing strength. These elements are preferably added each at 0.01% or more to obtain this effect. The effect is saturated even if these elements are added each in excess of 0.50%. Thus, one or more of these elements may be added each at a content in the range of 0.01% to 0.50%.

In our steel sheets, the balance of the chemical composition is represented by Fe and inevitable impurities. However, components other than those mentioned above may be added while still achieving the advantageous effects.

Metal Microstructure

The high strength steel sheet is substantially formed of a tempered-martensite single phase. The term "substantially" indicates that the steel sheet sometimes contains residual microstructures including inevitable untransformed, namely, retained austenite and ferrite microstructures. The microstructures may be identified by appropriately combining optical microscope observation (400× to 600×) and scanning electron microscope (hereinafter, abbreviated to "SEM") observation at 1000× magnification, or by any other appropriate methods. The proportions of the metal microstructures described hereinbelow are volume percentages assumed from the area ratio of metal microstructures according to an image processing apparatus.

Tempered-Martensite Core Microstructure

The core microstructure is substantially a tempered-martensite single phase to ensure strength and formability. Ferrite should be absent because even trace ferrite serves as a stress concentration site to drastically lower delayed fracture resistance. However, it is not necessary that the core microstructure be perfectly formed of tempered-martensite. That is, ferrite and/or retained austenite may be present as long as the content thereof is less than 3% because the effect of such trace microstructures on mechanical properties of the steel sheet can be ignored. The core microstructure may be identified by observing a microstructure found at ½ of the sheet thickness with an optical microscope and SEM.

Hardness and Thickness of Steel Sheet Superficial Soft Portion

The hardness and the thickness of a steel sheet superficial soft portion which satisfies Equations (1) and (2) below may be determined by measuring the hardness of the steel sheet with respect to a thickness cross section starting from a superficial section toward the core with intervals of 20 μm using a Vickers tester under a load of 50 g (test load: 0.49 N).

The steel sheet has a region in a steel sheet superficial portion that is softer than the core of the steel sheet. Such a soft region may be identified by the above-described hardness measurement starting from a steel sheet superficial section toward the core. The steel sheet superficial soft portion is a portion of the above-identified soft region that is defined by Equation (1) below.

That is, the steel sheet superficial soft portion needs to satisfy a hardness ratio relative to the core portion that is specified by the following equation:

$$Hv(S)/Hv(C) \leq 0.8 \quad (1)$$

wherein Hv(S) is the hardness of the steel sheet superficial soft portion, and Hv(C) is the hardness of the steel sheet core portion.

As shown above, the steel sheet superficial soft portion is a region having a hardness of 0.8×Hv(C) or less. If Hv(S)/Hv(C) is larger than 0.8, the difference in hardness from the core portion is small and such a region does not exhibit effects of improving the bendability and the delayed fracture resistance of the steel sheet. Thus, the Hv(S)/Hv(C) ratio is limited to be not more than 0.8. The satisfaction of this ratio also improves the fatigue properties of the steel sheet.

The hardness Hv(C) of the steel sheet core portion is an average of hardness values that are measured with respect to 5 points in a region found at ½ of the sheet thickness.

Further, the thickness of the steel sheet superficial soft portion defined by Equation (1) above needs to satisfy Equation (2) below:

$$0.10 \leq t(S)/t \leq 0.30 \quad (2)$$

wherein t(S) is the thickness of the steel sheet superficial soft portion, and t is the sheet thickness.

The thickness t(S) of the steel sheet superficial soft portion is obtained by measuring the hardness of the steel sheet starting from a superficial section toward the core along the sheet thickness so as to determine the thickness of a region with a hardness of not more than 0.8×Hv(C), and subsequently combining the thicknesses of such regions on the front and the back surfaces of the steel sheet. If the ratio of the thickness t(S) of the steel sheet superficial soft portion relative to the sheet thickness t is less than 0.10, the steel sheet cannot be markedly improved in terms of bendability as well as in delayed fracture resistance. Thus, the thickness ratio is limited to be not less than 0.10. If the thickness ratio exceeds 0.30, the strength of the steel sheet is markedly lowered to such an extent that maintaining a high strength exceeding 1270 MPa becomes very difficult. Thus, the thickness ratio is limited to be not more than 0.30.

Microstructure of Steel Sheet Superficial Soft Portion

The microstructure of the steel sheet superficial soft portion defined by Equations (1) and (2) contains tempered-martensite at a volume fraction of not less than 90% with respect to the entirety of the microstructure of the steel sheet superficial soft portion. When tempered-martensite represents not less than 90% of the steel sheet superficial soft portion, formability such as bendability described above is ensured.

The volume fraction of the tempered-martensite in this portion may be determined by observing the steel sheet superficial soft portion, which has been identified by the hardness measurement with respect to this and neighboring portions, over the entirety thereof starting from a superficial layer toward the core along the sheet thickness by optical microscope observation (400× to 600×) and SEM observation (1000×), and processing the obtained images to quantify the volume fractions of tempered-martensite and to obtain an average volume fraction in the portion. Ferrite may be locally present in a section from the surface to a depth of less than 5 μm, but the volume fraction of ferrite is preferably less than 10%. A smaller volume fraction of ferrite is more preferable because, in the case where the microstructure in such a superficial portion is based on ferrite, fatigue properties as well as tensile strength are markedly lowered. When the sheet thickness of the steel sheet is, for example, 0.8 to 1.6 mm, it becomes difficult to maintain strength of 1270 MPa or more if ferrite is formed in a portion that is 5 μm or more away from the steel sheet surface toward the core along the sheet thickness. Thus, ferrite is preferably absent in such a portion.

By controlling the chemical composition and the microstructure as described above, the obtainable ultra high strength steel sheet exhibits excellent bendability in such a manner that the superficial soft portion is deformed with a good balance with the deformation of the core layer of the steel sheet while relaxing the stress applied to the superficial layer of the steel sheet, and also exhibits excellent delayed fracture resistance. The reasons why the steel sheet achieves excellent delayed fracture resistance are not clear, but are probably because residual stress, in particular residual stress in the superficial portion, after pressing is lowered and further because generation of voids which serve as starting points of cracks is prevented by controlling the microstructure of the core portion along the sheet thickness to be a tempered-martensite-based homogeneous microstructure.

For example, the steel sheet may be manufactured by performing decarburization annealing to make the hardness of a steel sheet superficial soft portion become lower than the hardness of the core portion of the steel sheet such that Equation (1) is satisfied, in detail as described below. First, a steel material having the same chemical composition as the aforementioned steel sheet chemical composition is hot rolled, pickled, decarburization annealed and cold rolled, or is hot rolled, pickled, cold rolled and decarburization annealed. Thereafter, the resultant steel sheet is heated and soaked at not less than the $Ar_3$ transformation point during next continuous annealing, and subsequently quenched to the Ms transformation point or below. Alternatively, such a steel material is hot rolled, pickled and cold rolled, and is subsequently subjected to continuous annealing in which the steel sheet is decarburization annealed and thereafter heated and soaked at not less than the $Ar_3$ transformation point, and is finally quenched to the Ms transformation point or below. The amount of decarburization is not particularly limited. In the case of steel sheets with a sheet thickness of 0.8 to 1.6 mm, however, it is not preferable to perform decarburization to such an extent that the C content at a position 30 μm distant from the outermost surface layer becomes less than 0.10% because such a superficial soft portion easily forms a ferrite-based microstructure which causes a marked decrease in strength.

The decarburization annealing method is not particularly limited. For example, the carbon concentration in the steel sheet may be lowered by annealing the steel sheet in an oxygen-containing atmosphere or a high dew-point temperature atmosphere. Of the production steps, the series of steps in which the steel sheet is heated and soaked at not less than the $Ar_3$ transformation point by continuous annealing and the steel sheet is quenched are particularly important. Water cooling is a preferred quenching method in terms of small temperature variations in the sheet width direction and easiness in ensuring a cooling rate. However, the quenching method is not limited to water cooling, and other cooling methods such as gas jet cooling, mist cooling and roll cooling may be used singly or in combination with one another.

After quenching, the steel sheet is tempered at a temperature in the range of 150 to 400° C. Tempering at a temperature exceeding 300° C. results in a marked decrease in strength and involves a need for alloy elements to be added in large amounts to ensure 1270 MPa. Thus, the tempering temperature is preferably 150 to 300° C. Any other known methods may be adopted for the manufacturing of the steel.

EXAMPLE 1

Hereinbelow, our steel sheets will be described in detail based on examples. However, the scope of this disclosure is not limited to such examples.

Steel having a composition described in Table 1 was smelted and continuously cast to form a slab. The slab was heated to 1200° C. in a heating furnace and was hot rolled at a finish temperature of not less than 850° C. The hot-rolled steel sheet was coiled at a temperature of 500 to 650° C., and was thereafter pickled, cold rolled, decarburization annealed and continuously annealed to give an ultra high strength cold rolled steel sheet. The decarburization annealing for forming a steel sheet superficial soft portion was carried out in a high dew-point temperature atmosphere at 700 to 800° C. for 15 to 60 minutes. In the continuous annealing, soaking, cooling and tempering were performed under the conditions described in Table 2. The chemical composition of the obtained steel sheet was analyzed and found to be the same as described in Table 1.

TABLE 1

| Steel No. | C | Si | Mn | P | S | Al | N | Ti | Nb | V | B | Cu | Ni | Mo | Cr |
|---|---|---|---|---|---|---|---|---|---|---|---|---|---|---|---|
| 1 | 0.102 | 0.02 | 2.04 | 0.024 | 0.0020 | 0.032 | 0.0018 | — | — | — | — | — | — | — | — |
| 2 | 0.152 | 0.01 | 2.10 | 0.021 | 0.0017 | 0.042 | 0.0030 | — | — | — | — | — | — | — | — |
| 3 | 0.201 | 0.02 | 2.20 | 0.022 | 0.0017 | 0.039 | 0.0021 | — | — | — | — | — | — | — | — |
| 4 | 0.247 | 0.03 | 1.96 | 0.019 | 0.0014 | 0.034 | 0.0023 | — | — | — | — | — | — | — | — |
| 5 | 0.310 | 0.03 | 2.02 | 0.020 | 0.0014 | 0.033 | 0.0024 | — | — | — | — | — | — | — | — |
| 6 | 0.198 | 0.47 | 2.15 | 0.019 | 0.0014 | 0.046 | 0.0025 | — | — | — | — | — | — | — | — |
| 7 | 0.201 | 1.41 | 2.20 | 0.020 | 0.0018 | 0.049 | 0.0030 | — | — | — | — | — | — | — | — |
| 8 | 0.206 | 2.52 | 2.06 | 0.022 | 0.0017 | 0.039 | 0.0020 | — | — | — | — | — | — | — | — |
| 9 | 0.202 | 2.02 | 3.05 | 0.024 | 0.0021 | 0.042 | 0.0030 | — | — | — | — | — | — | — | — |
| 10 | 0.205 | 0.51 | 0.80 | 0.026 | 0.0014 | 0.025 | 0.0028 | — | — | — | — | — | — | — | — |

TABLE 1-continued

| Steel No. | C | Si | Mn | P | S | Al | N | Ti | Nb | V | B | Cu | Ni | Mo | Cr |
|---|---|---|---|---|---|---|---|---|---|---|---|---|---|---|---|
| 11 | 0.201 | 0.51 | 1.35 | 0.022 | 0.0016 | 0.028 | 0.0024 | — | — | — | — | — | — | — | — |
| 12 | 0.161 | 0.49 | 1.52 | 0.022 | 0.0018 | 0.042 | 0.0030 | — | — | — | — | — | — | — | — |
| 13 | 0.162 | 0.49 | 2.02 | 0.022 | 0.0017 | 0.030 | 0.0021 | — | — | — | — | — | — | — | — |
| 14 | 0.159 | 0.52 | 2.51 | 0.020 | 0.0014 | 0.032 | 0.0025 | — | — | — | — | — | — | — | — |
| 15 | 0.160 | 0.51 | 2.98 | 0.019 | 0.0014 | 0.033 | 0.0024 | — | — | — | — | — | — | — | — |
| 16 | 0.162 | 0.50 | 4.02 | 0.024 | 0.0016 | 0.039 | 0.0030 | — | — | — | — | — | — | — | — |
| 17 | 0.204 | 0.53 | 2.96 | 0.018 | 0.0019 | 0.035 | 0.0025 | — | — | — | — | — | — | — | — |
| 18 | 0.201 | 0.49 | 2.02 | 0.022 | 0.0017 | 0.042 | 0.0023 | 0.02 | 0.02 | — | 0.0012 | — | — | — | — |
| 19 | 0.203 | 0.51 | 1.94 | 0.019 | 0.0019 | 0.039 | 0.0024 | — | — | — | 0.0020 | — | — | — | — |
| 20 | 0.198 | 0.50 | 2.04 | 0.020 | 0.0021 | 0.034 | 0.0025 | — | — | — | 0.0040 | — | — | — | — |
| 21 | 0.197 | 0.52 | 1.98 | 0.022 | 0.0014 | 0.030 | 0.0030 | — | — | — | — | — | — | — | 0.21 |
| 22 | 0.201 | 0.48 | 1.96 | 0.024 | 0.0016 | 0.032 | 0.0018 | — | — | — | — | — | — | | 0.45 |
| 23 | 0.204 | 0.55 | 2.02 | 0.026 | 0.0018 | 0.033 | 0.0030 | — | — | — | — | — | — | 0.1 | — |
| 24 | 0.199 | 0.54 | 2.01 | 0.022 | 0.0017 | 0.033 | 0.0025 | — | — | — | — | 0.2 | 0.1 | — | — |
| 25 | 0.201 | 0.49 | 2.03 | 0.024 | 0.0017 | 0.039 | 0.0030 | — | — | 0.15 | — | — | — | — | — |
| 26 | 0.204 | 0.52 | 2.02 | 0.026 | 0.0017 | 0.030 | 0.0021 | — | 0.02 | — | — | — | — | — | — |

Unit: mass %

TABLE 2

| Steel No. | Sheet thickness (mm) | Soaking conditions (° C. × min) | Cooling* | Tempering (° C.) | Hv (c) | Soft portion thickness (μm) | Proportion of soft portion (%) | Core portion microstructure | Soft portion microstructure (%)** TM | F | TS (MPa) | El (%) | Λ (%) | Critical bend radius (mm) | Delayed fracture resistance test (hr) | Remarks |
|---|---|---|---|---|---|---|---|---|---|---|---|---|---|---|---|---|
| 1 | 1.2 | 860 × 5 min | WQ | 150 | 358 | 200 | 16.7 | TM | 93.5 | 6.5 | 1069 | 12.4 | 57.2 | 1.5 | >96 | COMP. EX. |
| 2 | 1.2 | 830 × 5 min | WQ | 150 | 442 | 200 | 16.7 | TM | 95.1 | 4.9 | 1318 | 10.4 | 50.2 | 2.5 | >96 | EX. |
| 3 | 1.2 | 830 × 5 min | WQ | 300 | 506 | 240 | 20.0 | TM | 94.7 | 5.3 | 1493 | 10.2 | 41.8 | 3.0 | >96 | EX. |
| 4 | 1.2 | 830 × 5 min | WQ | 300 | 574 | 300 | 25.0 | TM | 94.4 | 5.6 | 1596 | 9.1 | 40.2 | 3.0 | >96 | EX. |
| 5 | 1.2 | 830 × 5 min | WQ | 300 | 616 | 240 | 20.0 | TM | 94.8 | 5.2 | 1818 | 8.4 | 24.2 | 7.0 | 52 | COMP. EX. |
| 6 | 1.2 | 860 × 5 min | WQ | 300 | 501 | 200 | 16.7 | TM | 94.0 | 6.0 | 1496 | 11.2 | 42.1 | 3.0 | >96 | EX. |
| 7 | 1.2 | 860 × 5 min | WQ | 300 | 506 | 200 | 16.7 | TM | 95.1 | 4.9 | 1509 | 11.1 | 41.8 | 3.0 | >96 | EX. |
| 8 | 1.2 | 860 × 5 min | WQ | 300 | 513 | 200 | 16.7 | TM | 95.0 | 5.0 | 1248 | 13.5 | 49.6 | 2.5 | >96 | COMP. EX. |
| 9 | 1.2 | 860 × 5 min | WQ | 300 | 507 | 200 | 16.7 | TM | 94.5 | 5.5 | 1513 | 10.8 | 41.8 | 3.0 | 13 | COMP. EX. |
| 10 | 1.2 | 860 × 5 min | WQ | 300 | 512 | 240 | 20.0 | TM | 94.7 | 5.3 | 1238 | 12.8 | 41.5 | 3.0 | >96 | COMP. EX. |
| 11 | 1.2 | 860 × 5 min | WQ | 300 | 506 | 240 | 20.0 | TM | 94.2 | 5.8 | 1260 | 12.4 | 41.8 | 3.0 | >96 | COMP. EX. |
| 12 | 1.2 | 860 × 5 min | WQ | 300 | 446 | 200 | 16.7 | TM | 95.0 | 5.0 | 1331 | 11.9 | 52.6 | 2.5 | >96 | EX. |
| 13 | 1.2 | 830 × 5 min | WQ | 150 | 448 | 200 | 16.7 | TM | 94.8 | 5.2 | 1336 | 11.8 | 49.8 | 2.5 | >96 | EX. |
| 14 | 1.2 | 830 × 5 min | WQ | 150 | 443 | 200 | 16.7 | TM | 94.9 | 5.1 | 1322 | 11.9 | 54.3 | 2.0 | >96 | EX. |
| 15 | 1.2 | 830 × 5 min | WQ | 150 | 445 | 240 | 20.0 | TM | 94.9 | 5.1 | 1313 | 12.0 | 48.5 | 2.5 | >96 | EX. |
| 16 | 1.2 | 830 × 5 min | WQ | 150 | 448 | 200 | 16.7 | TM | 94.9 | 5.1 | 1336 | 8.7 | 48.8 | 2.5 | 2 | COMP. EX. |
| 17 | 1.2 | 830 × 5 min | WQ | 150 | 510 | 200 | 16.7 | TM | 94.0 | 6.0 | 1522 | 10.4 | 33.2 | 3.0 | >96 | EX. |
| 18 | 1.2 | 860 × 5 min | WQ | 300 | 506 | 200 | 16.7 | TM | 95.1 | 4.9 | 1509 | 10.5 | 37.6 | 3.0 | >96 | EX. |
| 19 | 1.2 | 860 × 5 min | WQ | 300 | 509 | 200 | 16.7 | TM | 95.0 | 5.0 | 1518 | 10.4 | 37.5 | 3.0 | >96 | EX. |
| 20 | 1.2 | 830 × 5 min | WQ | 300 | 501 | 200 | 16.7 | TM | 95.1 | 4.9 | 1496 | 10.6 | 37.8 | 3.0 | >96 | EX. |
| 21 | 1.2 | 830 × 5 min | WQ | 300 | 500 | 200 | 16.7 | TM | 94.7 | 5.3 | 1491 | 10.6 | 37.9 | 3.0 | >96 | EX. |
| 22 | 1.2 | 830 × 5 min | WQ | 300 | 506 | 200 | 16.7 | TM | 95.2 | 4.8 | 1509 | 10.5 | 37.6 | 3.0 | >96 | EX. |
| 23 | 1.2 | 860 × 5 min | WQ | 300 | 510 | 200 | 16.7 | TM | 95.2 | 4.8 | 1522 | 10.4 | 37.4 | 3.0 | >96 | EX. |
| 24 | 1.2 | 830 × 5 min | WQ | 300 | 503 | 200 | 16.7 | TM | 94.8 | 5.2 | 1500 | 10.5 | 37.8 | 3.0 | >96 | EX. |
| 25 | 1.2 | 860 × 5 min | WQ | 300 | 506 | 200 | 16.7 | TM | 94.5 | 5.5 | 1509 | 10.5 | 37.6 | 3.0 | >96 | EX. |
| 26 | 1.2 | 860 × 5 min | WQ | 300 | 510 | 200 | 16.7 | TM | 94.3 | 5.7 | 1522 | 10.4 | 37.4 | 3.0 | >96 | EX. |

*water hardening to not more than 20° C.

**TM: tempered-martensite,

F: ferrite

Underlines indicate COMPARATIVE EXAMPLES.

TABLE 3

| Test code | Steel No. | Sheet thickness (mm) | Decarburization conditions | Soaking conditions (° C. × min) | Cooling | Tempering (° C.) | Hv (c) | Soft portion thickness (μm) | Proportion of soft portion (%) |
|---|---|---|---|---|---|---|---|---|---|
| A | 3 | 1.2 | dew-point temp. 30° C., 700° C. × 20 min | 830 × 5 min | WQ | 300 | 506 | 240 | 20.0 |
| B | 3 | 1.2 | dew-point temp. 15° C., 650° C. × 20 min | 830 × 5 min | WQ | 300 | 505 | 100 | 8.3 |
| C | 3 | 1.2 | dew-point temp. 30° C., 700° C. × 30 min | 830 × 5 min | WQ | 300 | 509 | 340 | 28.3 |
| D | 3 | 1.2 | dew-point temp. 30° C., 700° C. × 60 min | 830 × 5 min | WQ | 300 | 503 | 500 | 41.7 |
| E | 14 | 1.2 | dew-point temp. 30° C., 700° C. × 30 min | 830 × 5 min | WQ | 150 | 443 | 200 | 16.7 |
| F | 14 | 1.2 | dew-point temp. 30° C., 700° C. × 30 min | 780 × 5 min | WQ | 150 | 354 | 200 | 16.7 |
| G | 14 | 1.2 | dew-point temp. 30° C., 700° C. × 30 min | 800 × 5 min | WQ | 150 | 401 | 200 | 16.7 |

| Test code | Core Portion Micro-Structure: (volume fraction, %) | Soft portion Micro-Structure (volume fraction, %) TM | F | TS (MPa) | El (%) | Λ (%) | Critical bend radius (mm) | Delayed fracture resistance test (hr) | Remarks |
|---|---|---|---|---|---|---|---|---|---|
| A | TM | 94.7 | 5.3 | 1493 | 10.2 | 41.8 | 3.0 | >96 | EX. |
| B | TM | 95.6 | 4.4 | 1546 | 9.4 | 42.5 | 5.5 | 48 | COMP. EX. |
| C | TM | 91.6 | 8.4 | 1372 | 11.8 | 55.6 | 2.0 | >96 | EX. |
| D | TM | 67.6 | 32.4 | 1185 | 14.1 | 56.7 | 1.5 | >96 | COMP. EX. |
| E | TM | 94.9 | 5.1 | 1322 | 11.9 | 54.3 | 2.0 | >96 | EX. |
| F | F (24) + TM (86) | 55.0 | 45.0 | 1056 | 16.5 | 57.2 | 0.5 | >96 | COMP. EX. |
| G | F (5) + TM (95) | 88.0 | 12.0 | 1196 | 13.8 | 54.2 | 1.5 | 52 | COMP. EX. |

Underlines indicate COMPARATIVE EXAMPLES.
TM: tempered-martensite
F: ferrite

The results in Table 2 mainly show the effects of the chemical compositions of the steel sheets examined under constant decarburization annealing conditions at a dew-point temperature of 30° C. and at 700° C. for 30 min. The results in Table 3 show how mechanical properties (tensile properties, hole expansion ratio, bendability) and delayed fracture resistance would be affected by the thickness (μm) of the soft portion and the core portion microstructure which were varied by appropriately controlling the decarburization conditions, the soaking temperature and the tempering temperature. In each of the tables, the steel sheet superficial soft portion and the steel sheet core portion are abbreviated as "soft portion" and "core portion," respectively.

After being polished and etched with Nital, a microstructure of the steel sheet core portion that was found at ½ of the sheet thickness was observed by optical microscope observation (400×) and SEM observation (1000×) to determine whether any ferrite microstructure was present or absent. In the case where a ferrite microstructure was present, the fraction (the area fraction) of ferrite was measured by image processing and was assumed to be equal to the volume fraction. Prior to the observation of a microstructure of the superficial soft portion, the thickness of a region corresponding to the superficial soft portion was determined with respect to each of the front and the back surfaces by hardness distribution measurement and the obtained thicknesses were combined. Thereafter, the cross section was polished and etched with Nital, and the microstructure of the superficial soft portion was observed by optical microscope observation and SEM observation (1000×). The hardness of the steel sheet was measured using a Vickers tester under a load of 50 g (test load: 0.49 N) with intervals of 20 μm with respect to 5 points at each interval, the results being averaged, thereby obtaining a hardness distribution in the cross section along the steel sheet direction. The hardness of the steel sheet core portion was determined by measuring the hardness with respect to 5 points in a region found at ½ of the sheet thickness, and calculating the average hardness. Namely, the hardness distribution in the thickness cross section obtained above was studied to identify a region in the steel sheet superficial section that satisfied a hardness of not more than 0.8×Hv(C), and the thickness of this region as the steel sheet soft portion was determined and the microstructure of the region was observed.

The tensile test was carried out in accordance with JIS Z 2241 with respect to a JIS No. 5 test piece which had been sampled such that its length would be perpendicular to the rolling direction. The hole expansion test was performed in accordance with JFS T 1001, The Japan Iron and Steel Federation Standards. The bendability test was performed in accordance with JIS Z 2248. In detail, strip-shaped test pieces were cut out along a direction perpendicular to the rolling direction and were bent at 180° into a U-shape while changing the bend radius, and bendability was evaluated based on the critical bend radius. The steel sheet may be evaluated to be excellent in bendability when the critical bend radius is 5.0 mm or less.

The delayed fracture test was carried out using a test piece similar to that used in the bendability test. In detail, a test piece that had been bent into a U-shape with a bend radius R of 5 mm was immersed into hydrochloric acid at pH 3 until a crack occurred. The maximum immersion time was set at 96 hours. Delayed fracture resistance was evaluated based on whether or not a crack occurred within this immersion time. For materials which had a critical bend radius R of more than 5 mm, test pieces were prepared with a bend radius R that was 1 mm larger than the critical bend radius R. The absence of cracks after an immersion time of 96 hours (>96 hr) indicates that delayed fracture resistance is excellent.

The results are described in Tables 2 and 3. From Tables 2 and 3, the comparison between our EXAMPLES and COMPARATIVE EXAMPLES shows that our steel sheets achieved a tensile strength of not less than 1270 MPa and exhibited excellent bendability and delayed fracture resistance.

The invention claimed is:

1. An ultra high strength cold rolled steel sheet with excellent bendability which comprises, in terms of mass %, C at 0.15 to 0.30%, Si at 0.01 to 1.8%, Mn at 1.5 to 3.0%, P at not more than 0.05%, S at not more than 0.005%, Al at 0.005 to 0.05% and N at not more than 0.005%, with the balance being represented by Fe and inevitable impurities, and has a steel sheet superficial soft portion satisfying Equations (1) and (2):

$$Hv(S)/Hv(C) \leq 0.8 \quad (1)$$

wherein Hv(S) is hardness of the steel sheet superficial soft portion, and Hv(C) is hardness of a steel sheet core portion, $$0.10 \leq t(S)/t \leq 0.30 \quad (2)$$

wherein t(S) is a thickness of the steel sheet superficial soft portion, and t is sheet thickness, the steel sheet superficial soft portion containing tempered-martensite at a volume fraction of not less than 90%, a microstructure of the steel sheet core portion including tempered-martensite, the ultra high strength cold rolled steel sheet having a tensile strength of not less than 1270 MPa.

2. The steel sheet according to claim 1, further comprising, in terms of mass %, one or more selected from Ti: 0.001 to 0.10%, Nb: 0.001 to 0.10% and V: 0.01 to 0.50%.

3. The steel sheet according to claim 1, further comprising, in terms of mass %, B at 0.0001 to 0.005%.

4. The steel sheet according to claim 1, further comprising, in terms of mass %, one or more selected from Cu: 0.01 to 0.50%, Ni: 0.01 to 0.50%, Mo: 0.01 to 0.50% and Cr: 0.01 to 0.50%.

5. The steel sheet according to claim 2, further comprising, in terms of mass %, B at 0.0001 to 0.005%.

6. The steel sheet according to claim 2, further comprising, in terms of mass %, one or more selected from Cu: 0.01 to 0.50%, Ni: 0.01 to 0.50%, Mo: 0.01 to 0.50% and Cr: 0.01 to 0.50%.

7. The steel sheet according to claim 3, further comprising, in terms of mass %, one or more selected from Cu: 0.01 to 0.50%, Ni: 0.01 to 0.50%, Mo: 0.01 to 0.50% and Cr: 0.01 to 0.50%.

* * * * *